US005918883A

United States Patent [19]

McKenzie et al.

[11] Patent Number: 5,918,883

[45] Date of Patent: Jul. 6, 1999

[54] METHOD OF PLAYING A BOARD GAME

[76] Inventors: Richard Brooke McKenzie, 602 Yaldhurst Rdoad, Christchurch RD6; Roger John Swolf, 18/10 Ayr Street, Christchurch, both of New Zealand

[21] Appl. No.: 09/014,749

[22] Filed: Jan. 28, 1998

[30] Foreign Application Priority Data

Jan. 31, 1997 [NZ] New Zealand ..... 314172
Apr. 11, 1997 [NZ] New Zealand ..... 314591

[51] Int. Cl.[6] ..... A63F 3/00

[52] U.S. Cl. ..... 273/271; 273/264; 463/10

[58] Field of Search ..... 273/264, 271; 463/10

[56] References Cited

U.S. PATENT DOCUMENTS 1,521,095 12/1924 Harris ..... 273/271
3,111,320 11/1963 Acosta ..... 273/264 X
3,342,493 9/1967 Lang ..... 273/271
4,092,029 5/1978 Jones ..... 273/271
4,139,199 2/1979 Drummond ..... 273/271 X
4,213,616 7/1980 Dickey ..... 273/271
4,302,015 11/1981 Bowser et al. ..... 273/271
4,346,897 8/1982 Sisak ..... 273/271
4,720,108 1/1988 Gramera ..... 273/271
5,011,159 4/1991 Fortunato et al. ..... 273/260
5,248,149 9/1993 Tarrats ..... 273/271
5,301,952 4/1994 Fitzgerald ..... 273/264 X
5,318,307 6/1994 Bouchard et al. ..... 273/271 X
5,413,350 5/1995 Taylor et al. ..... 273/271
5,415,413 5/1995 Morinich ..... 273/271

*Primary Examiner*—William E. Stoll
*Attorney, Agent, or Firm*—Greer, Burns & Crain, Ltd.

[57] ABSTRACT

A method of playing a board game for one or more players includes the steps of allocating a set of playing pieces for each player, each set being visually distinctive, and providing a playing surface. The playing surface contains defined spaces arrayed in two dimensions. Each space may have an identifying icon. The method includes variations for forming winning lines of playing pieces, and varying steps to play the game, depending on the level of difficulty and style of game required. The most frequently used method of determining a winning outcome is by the placement by one player of playing pieces to form a line from one side of the playing surface to another side without diagonal connecting links between pieces. Random number generators may be used. If icons are used, a random icon generator includes the same icons as those used to identify spaces on the playing surface for determining where a player may place a piece.

17 Claims, 5 Drawing Sheets

METHOD OF PLAYING A BOARD GAME

BACKGROUND OF THE INVENTION

The present invention relates to a game for one or two or more players. An object of the invention is the provision of a game the basic rules of which are simple, but which can involve considerable skill. A further object of the invention is the provision of such a game wherein it can be played with a suitable board and other accessories, or which can be the subject of a computer program such that the game can be played on or with appropriate electronic equipment.

BRIEF SUMMARY OF THE INVENTION

The present invention provides apparatus for playing a game for one or more players, comprising:

a set of playing pieces for use by a player, each set being visually distinctive from any other set, each set including a plurality of identical pieces;

a playing surface which contains a plurality of defined spaces arrayed in two dimensions within a framework, each space containing thereon an identifying icon, wherein each icon is selected from a group of icons of finite number and wherein each icon appears on the playing surface a plurality of times; and one or more "random number" generators each of which includes at least one occurrence of each icon on the playing surface; and wherein the game is played in accordance with the following rules:

the number of players is ascertained and the conditions for forming a winning line are pre-determined and a first player decided upon;

each player is allocated a set of playing pieces and the or all random number generators are used by each player in turn;

each player places one or more of the allocated set of playing pieces on the playing surface on icons corresponding to the icons generated for that turn by the random number generator, said number of playing pieces being determined by the icons showing on that turn on the random number generator; and the players continue until one player has achieved a winning combination of pieces, fulfilling the pre-determined winning combination for that game.

Preferably the random number generators are dice and two or more dice are used.

The icons may be any set of representations which, for example, is selected from the group consisting of: numbers, letters, colours, sets of graphic representations, symbols, or a combination of any of these. Preferably, the icons used are the numbers one to six (1 to 6), corresponding to the numbers on standard dice.

Preferably the playing surface is a board with a framework that is geometrically regular. Each icon or number preferably appears on the surface the same number of times as any other icon or number.

Most preferably, the playing surfaces includes especial spaces which can be used by one player or more than one player when a special combination of random numbers is generated at the same time, for example three sixes.

Preferably the various combinations of values allocated to especial spaces, the number of dice played with and the other pre-selected rules of the game permit the game to be played at varying levels of skill and by players of varying ages, using the same playing surface (or the same range of playing surfaces), and a range of dice.

A further embodiment of the present invention is the provision of the above game when embodied in a computer program wherein the or each random number generator is incorporated into the program of the computer (or a pre-existing program is used), the playing surface is displayed on one or more visual display units and the placement of playing pieces is conducted by keyboard strokes or other computer control device. Advantageously, when there are two or more players, the players may be remote from one another.

The present invention further provides apparatus for playing a game for one or more players, comprising:

a set of playing pieces for use by a player, each set being visually distinctive from any other set, each set including a plurality of pieces;

a playing surface which contains a plurality of defined spaces arrayed in two dimensions within a framework; and wherein the game is played in accordance with the following rules:

the number of players is ascertained and the conditions for forming a winning line are pre-determined and a first player decided upon;

each player is allocated a set of playing pieces and the number of pieces to be played at each turn is determined;

each player places one or more of the allocated set of playing pieces on the playing surface in accordance with the determination of that player for the best option to win the game; and the players continue until one player has achieved a winning combination of pieces, fulfilling the pre-determined winning combination for that game.

Preferably the playing surface is a board with a framework that is geometrically regular. Optionally, the playing surfaces includes especial spaces which can be used by one player or more than one player, or in accordance with pre-determined rules.

Advantageously, each set of playing pieces includes a plurality of sub-sets of identical playing pieces, each sub-set having one or more rules about when a playing piece from that sub-set may be played. Each sub-set also has one or more rules relating to the manner in which other players may treat that sub-set of playing pieces when played.

Preferably the various combinations of values allocated to especial spaces, the number and playing pieces to be played, the types (or sub-set) of playing pieces and the other pre-selected rules of the game, permit the game to be played at varying levels of skill and by players of varying ages, using the same playing surface (or the same range of playing surfaces).

A still further embodiment of the present invention is the provision of the above game when embodied in a computer program, the playing surface being displayed on one or more visual display units and the placement of playing pieces being conducted by keyboard strokes or other computer control device. Advantageously, when there are two or more players, the players may be remote from one another.

The present invention further provides apparatus for playing a game for one or more players, comprising:

a set of playing pieces for use by a player, each set including a plurality of sub-sets of playing pieces each sub-set being playable in accordance with a set rule of the game, each set being visually distinctive from any other set, and each sub-set including a limited, pre-determined number of identical pieces;

a playing surface which contains a plurality of defined spaces arrayed in two dimensions within a framework, and wherein the game is played in accordance with the following rules:

the number of players is ascertained and the conditions for forming a winning line are pre-determined and a first player decided upon;

each player is allocated a set of playing pieces, and the number or combination of pieces which can be played at each turn is determined;

each player places one or more of the allocated set of playing pieces on the playing surface in accordance with the determination of that player for the best option to win the game and in accordance with the rules determining the number of pieces or combination of pieces which may be played at any one turn; and the players continue until one player has achieved a winning combination of pieces, fulfilling the pre-determined winning combination for that game, or all players cannot play any further.

Preferably the playing surface is a board with a framework that is geometrically regular. Optionally, the playing surfaces includes especial spaces which can be used by one player or more than one player, or in accordance with pre-determined rules.

A yet further embodiment of the present invention is the provision of the above game when embodied in a computer program, the playing surface being displayed on one or more visual display units and the placement of playing pieces is conducted by keyboard strokes or other computer control device. Advantageously, when there are two or more players, the players may be remote from one another.

Advantageously, the above aspect of the present invention may also be played with a playing surface which contains a plurality of defined spaces arrayed in two dimensions within a framework, each space containing thereon an identifying icon, wherein each icon is selected from a group of icons of finite number and wherein each icon appears on the playing surface a plurality of times; and one or more random number generators each of which includes at least one occurrence of each icon on the playing surface; and the rules of the game include that each player places one or more of the allocated set of playing pieces on the playing surface on icons corresponding to the icons generated for that turn by the random number generator.

BRIEF DESCRIPTION OF THE DRAWINGS

By way of example only, preferred embodiments of the present invention will be described in detail with reference to the accompanying drawings, in which.

DETAILED DESCRIPTION

Figure 1:
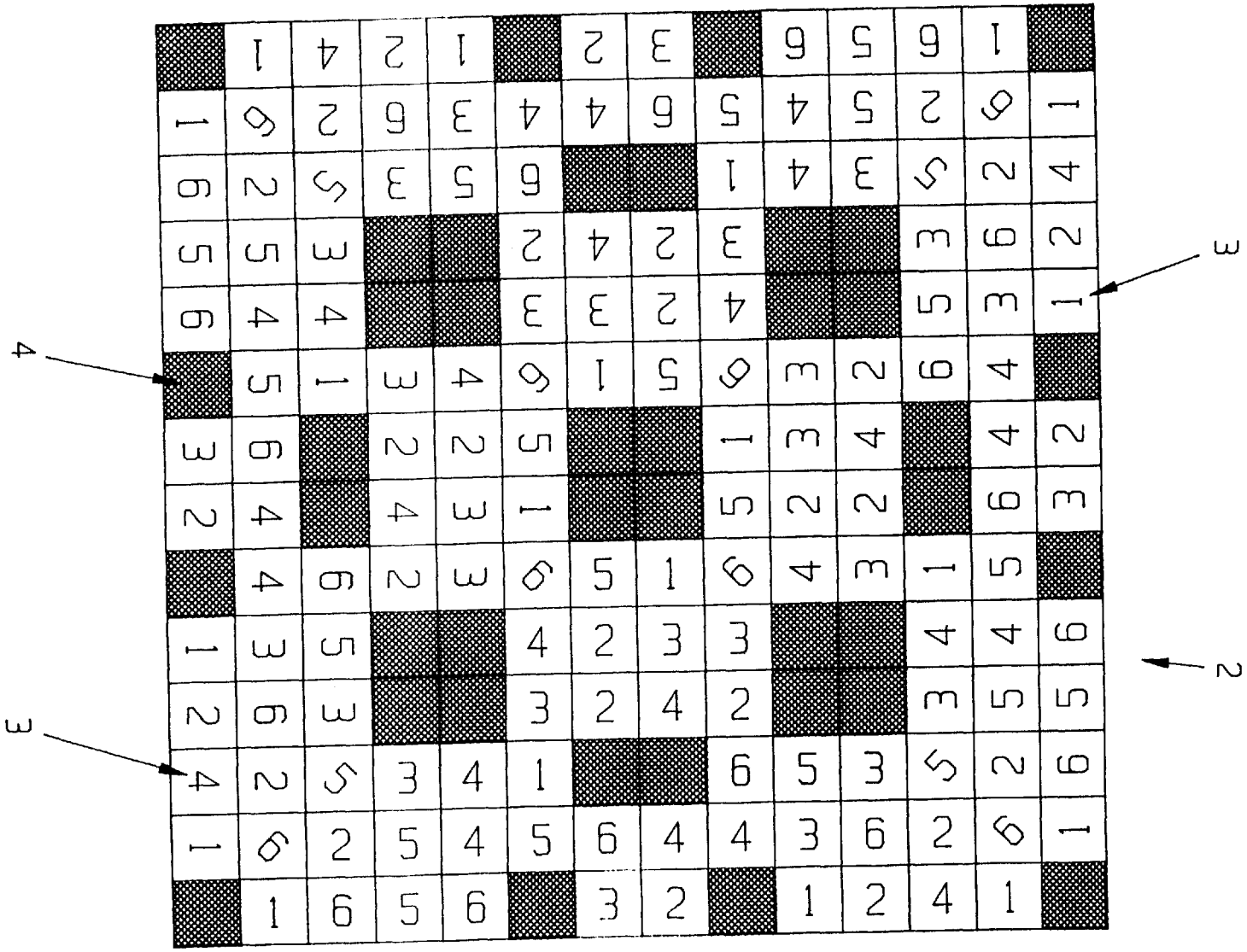
FIG. 1 is a plan view of the playing surface of a first preferred embodiment of the present invention, as a sample game.
Figure 2:
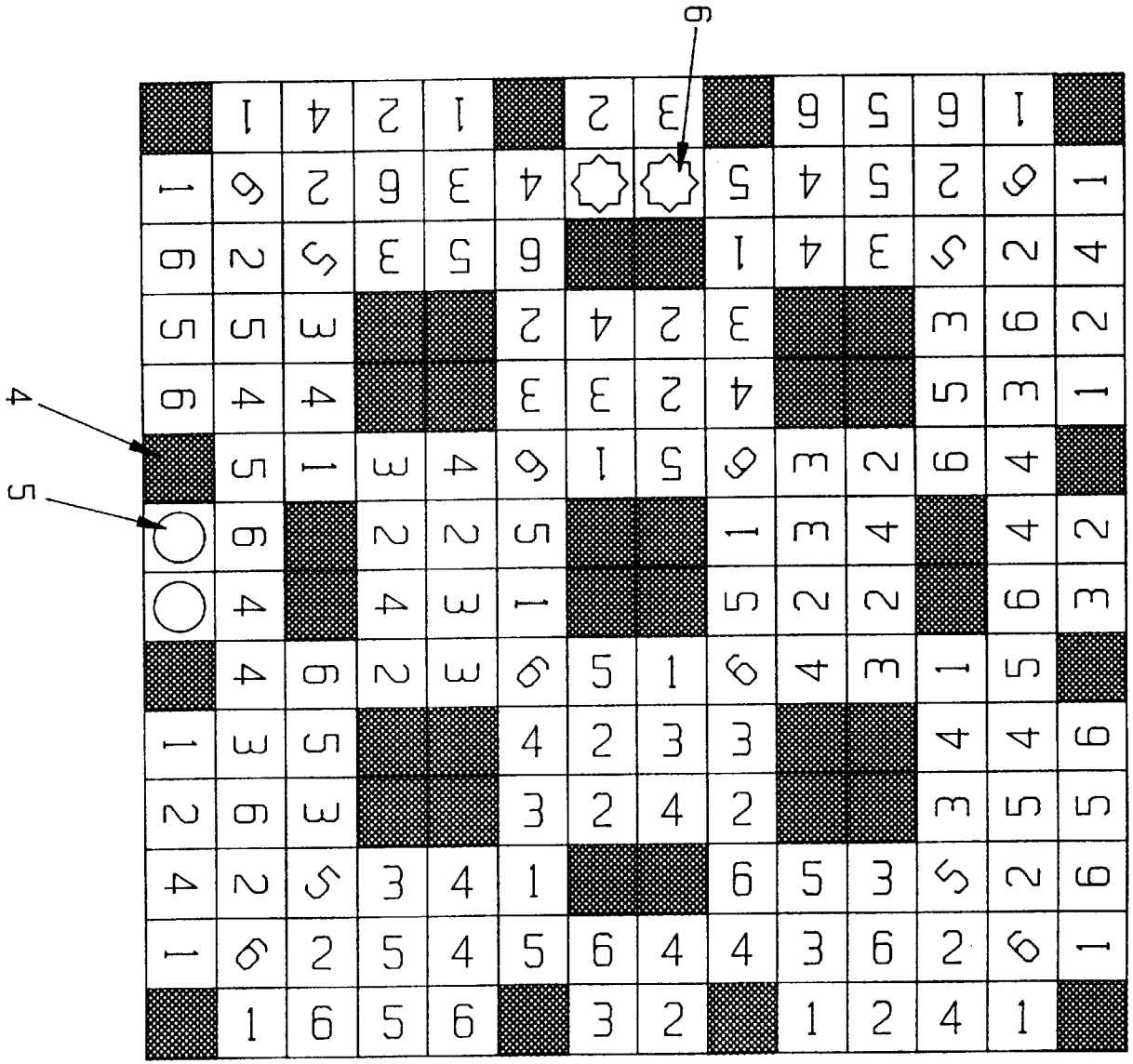
FIG. 2 shows the first moves of a two player game using the playing surface of FIG. 1.
Figure 3:
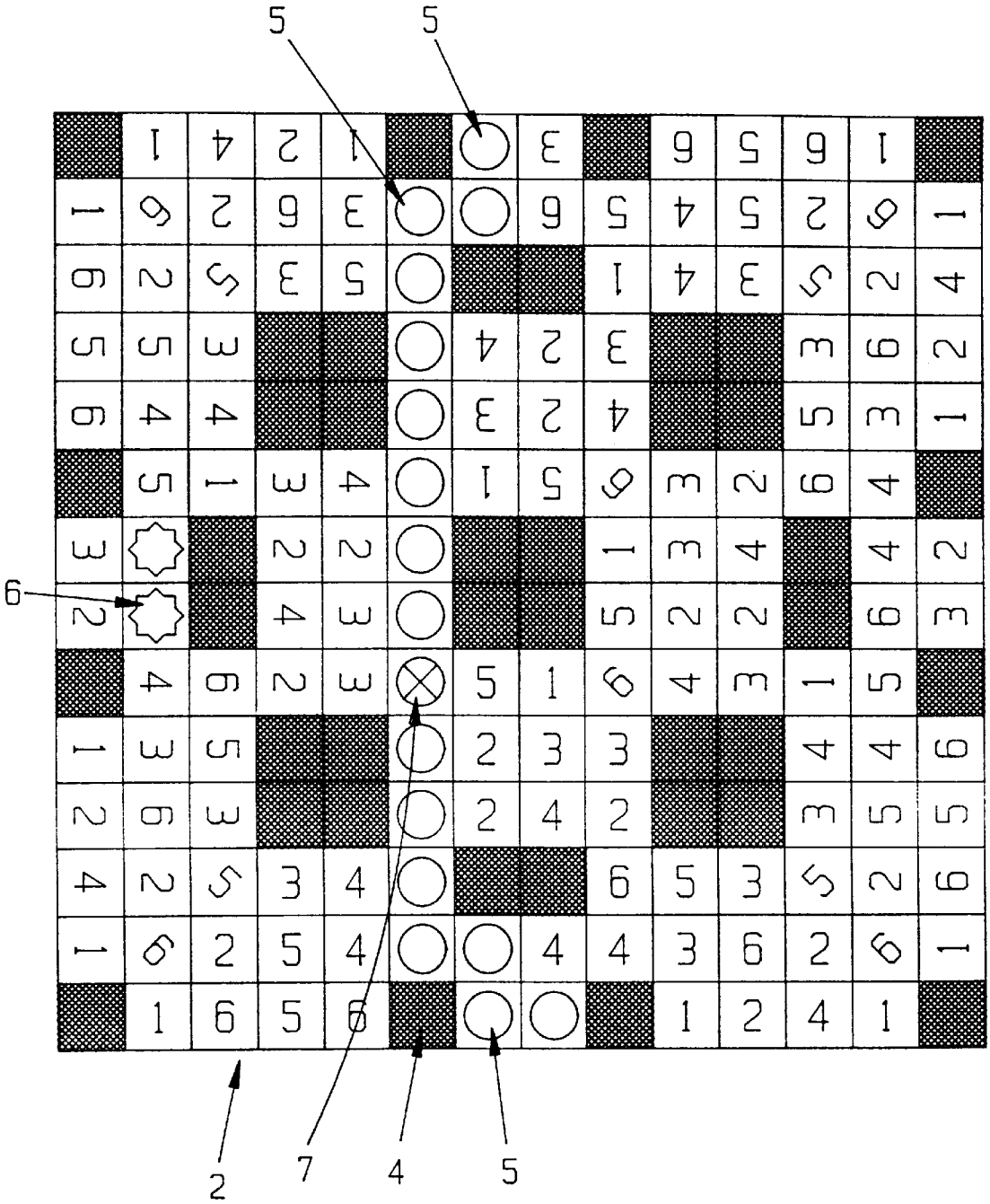
FIG. 3 shows a winning arrangement of a two player game using the playing surface of the first preferred embodiment of FIG. 1.

Referring to FIGS. 1 to 3 of the drawings, a square board 2 is thereshown that is 14 squares by 14 squares (3) along each side. All squares are of equal size. Each square 3 includes a design or a number. Each number used ("1" to "6") corresponds to the numbers represented on the sides of the dice (not shown) which are used by the players of the game. In this embodiment, the dice are known dice, with the numbers "1" to "6" arranged and identified by dots on the six sides of each die.

Each of the numbers "1" to "6" on the squares 3 of the board 2 are repeated an approximately equal number of times on the board 2, as compared with any other number. Thus all squares 3 with numbers have an equal chance of corresponding to the numbers thrown by chance by the fall of the dice.

Blank squares 4, which are visually differentiated from the numbered squares 3, may be used by a player under certain rules of the game.

Each player uses a set of playing pieces (5, 6 in FIGS. 2 and 3) which are visually distinct from those of any other player and are generally all the same. For example one player may use circular playing pieces 5 and another player may use polygonal playing pieces 6. The distinguishing feature of each set of playing pieces may be any visually distinctive feature, for example colour, symbols on the playing pieces, the shape of the pieces, etc.

The players determine the starting player, either by chance or by arrangement and selection. The players, if so desired, may determine some or all of the rules of the game to be used for the game.

The rules of the game include the following: the winning combination of pieces on the board 2 is determined and agreed on. The players take turns sequentially. As each player throws the dice, he may place a playing piece over one of the numbers on his turn at play. For example, if two dice are used and the numbers "3" and "4" come up then that player may place a playing piece (5, 6) over one "3" and one "4" on the board 2. The determination of the placement of the playing pieces (5, 6) on the squares 3 is made by the player, in accordance with the player's analysis of the best options for winning the game.

A player may place a piece on a blank square when a double is thrown.

No numbered square 3 may contain more than one playing piece.

The game is won when the pre-determined object of the game is achieved by one player. For example, the winner may be the first person to achieve a line of playing pieces from one side of the board 2 to the other, where no diagonal connections are permitted. This line may not be ruler straight, but may be staggered first in one direction and then in the second, but progressing from one side of the board 2 to the opposite side (or as required for the winning condition of that game).

Referring to FIGS. 2 and 3, the initial moves of such a game between two players, with two dice are shown. The first player, using round playing pieces 5, has thrown the dice to reveal the numbers "3" and "2", and accordingly has covered each of one corresponding number at the start of a possible line across the board 2.

The second player, using the polygonal pieces 6, has thrown the numbers "6" and "4" on his turn. Likewise he has chosen to place pieces close to the start of his attempt to form a line of pieces across the board 2.

In FIG. 3, a winning line from the first player is thereshown. In this instance, the player threw no doubles on his turn with the dice and therefore was not able to place a playing piece on a blank square 4.

In alternative embodiments of the rules, the blank squares 4 may be used by any player at any time in order to complete a straight line across the board 2. Similarly, by the provision of a sub-set of pieces (7) for each player that are visually distinctive from each set of pieces (5 or 6), a piece (7) may be placed on a square 3 when a double is thrown, so that that square 4 cannot be used by any other player. Such a "blocked" square may be incorporated into a winning line (FIG. 3) only for the player whose blocked piece 7 is on a square 3 in the possible winning line.

In the example shown in FIGS. 1 to 3, the winning line is from one side of the board 2 to the other, without diagonal connections but not necessarily as a straight line. In practice it has been found that this winning arrangement works best for an even number of players. Whether there are odd or even numbers of players, the point of start and finish of a line may be varied. For example, each of four players may need to complete a diagonal line from one corner of the board to the diagonal corner opposite. When two possible lines from different players cross, the rules may be set so that more than one piece (5 or 6) may be placed on one square 3 by the throwing of a double on the dice, by the second player.

As an alternative, or as an addition to the above rules, the degree of difficulty may be raised by a requirement that the winning line touch a particular side of the board 2, or that the winning line must pass through or adjacent the centre of the board 2.

If so desired, more than two dice may be used. For example, three dice can be used to allow each player to place three playing piece on the board 2 on each turn and to increase the occurrence of doubles.

The board 2 and squares 3 are shown as being square. However, it will be appreciated that the board 2 could be rectangular, octagonal or any other desired shape, including irregularly shaped. Further, the size of each square 3 may be rectangular or some other shape and the squares 3 may be unevenly arrayed on the board 2.

The two different sets of playing pieces (5 or 6) for each player (in the instance when blockers 7 are used) may, for example, be flat counters with blockers 7 being of a greater height (rather than marked as shown in FIG. 3), if so desired. The number of blockers 7 may be limited in each set, if so desired.

Figure 4:
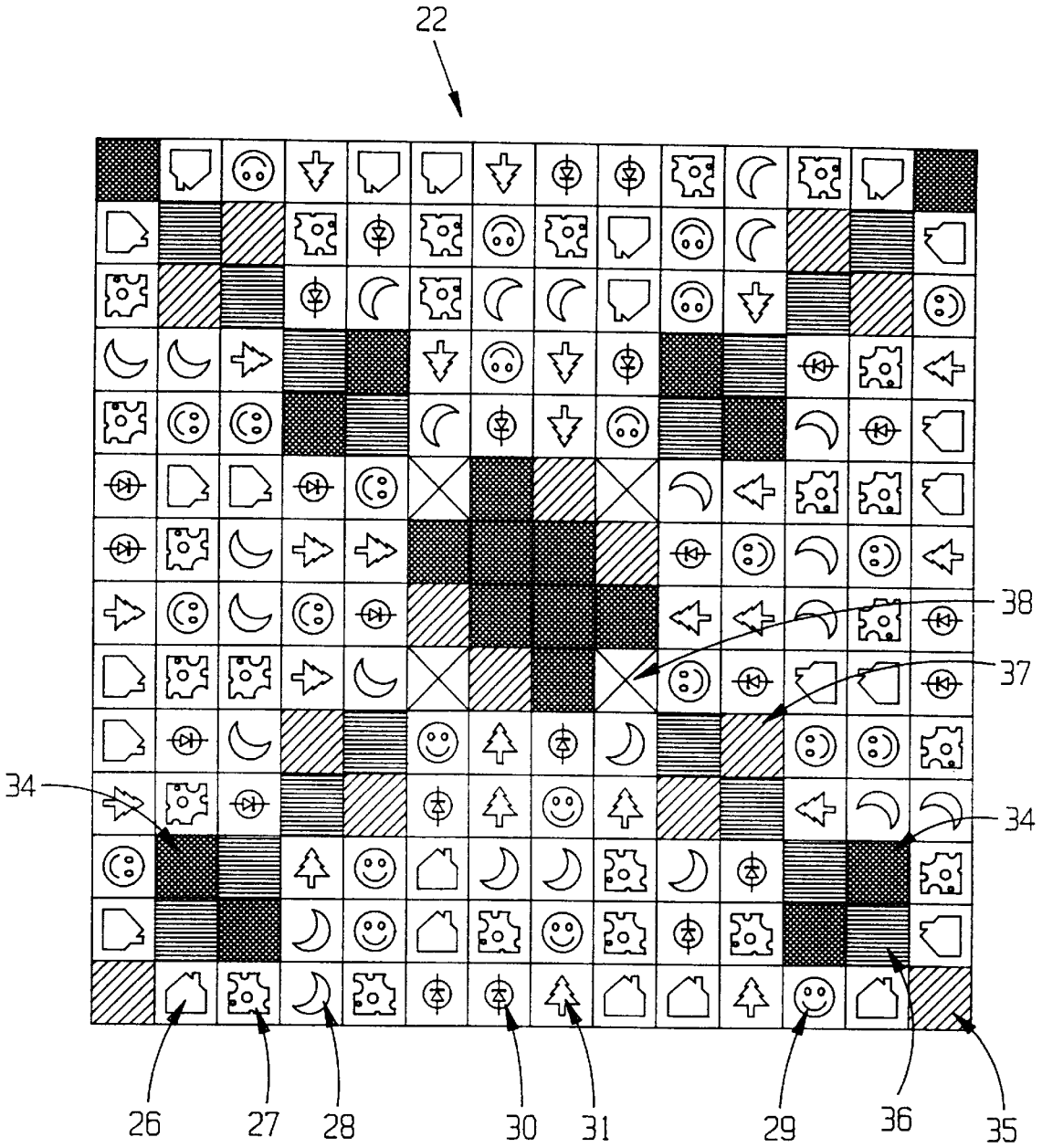
FIG. 4 is a plan view of a second embodiment of the playing surface of the present invention.

Referring to FIG. 4, a second embodiment of the board 22 is thereshown. The squares 23 are identified by a series of six icons—house (26), cheese (27), moon (28), face (29), transistor (30), and tree (31). As with the first embodiment, the number of occurrences of each of these icons (26–31) is approximately equal to that of any other icon. The random number generator used with this board includes one of each icon (24 to 31).

Free squares 34 are also present on board 22. Additionally, sets of hazard squares (35–38) are also present in a prearranged pattern. Each set of hazard squares (35–38) may be used when needed by a player to attempt to make a winning line. However, in use they may represent a penalty for that player.

Examples of such hazards may include: losing a turn if a square (35) is used; losing the next double thrown (and thus the ability to block with a double) (36); removing one blocking piece or other piece from the board (37) and allowing another player to place a blocking piece on the board (38). Other hazard rules or penalties may be used in additions to the above or as an alternative, as is desired.

Each of these two embodiments is described with the use of six icons (3, 24–31). However it will be appreciated that the number of icons may be fewer or more, as is desired, and depending on the random number generator. For example, if a larger board, with a greater number of squares is to be used (for example with 6 or more players), the number of different icons may be up to ten (for example). In such instances, an electronic random number generator may be used or appropriately sided dice.

The playing pieces (5, 6) may be of any appropriate material for retaining colour, impressions or the ability to be visually distinctive. The board 2 may be of any appropriate material (if non-electronic). The playing surface may be permanently printed or impressed thereon. Alternatively, the playing surface may be on a sheet of plastic which can be affixed to the board 2. A plurality of plastic sheets may retain the same arrangement of different sets or icons, or may contain different arrangements of the spaces 3, as is desired. A plurality of combinations of either style may also be used in successive games, or to suit the skills of the respective sets of players.

Whilst two preferred embodiments of the board 2, 22 of the present invention have been shown, it will be appreciated that there are a large number of variations that are possible without departing from the scope of the invention. For example, a triangular board may be used for three players; a pentagonal board for five players. The arrangement of the icons (26–31) or numbers (3) may be varied, from game to game if so desired. The number and arrangement of any hazard squares (35–38) may be varied.

Also it will be appreciated that the rules regarding the number of playing pieces 5,6 which may be played by a player in any one turn may be varied; the rules about the existence and use of blockers 7 may be absent or may be varied, if present. It will be appreciated that by the suitable arrangement of such rules, the same sets of board 2, 22 and pieces can be used for a game for young children who cannot read, or any age of player with any degree of skill.

In a further preferred embodiment the board, dice and playing pieces are all represented on a visual display unit (not shown) and the rules and operation of the game embodied in a computer program. The game can be played "electronically" with the placement of playing pieces being controlled by a keyboard, mouse, joystick or other means of instructing the operation of a computer or electronic device. The computer program may also be embodied in a microcontroller for a games machine, which may not necessarily be viewed as a computer or a computer controlled device.

Referring to FIGS. 1 to 3 of the drawings, and the first two embodiments of the present invention, additional rules may be included as follows:

- the rule that any one player may place a playing piece (5, 6) over a playing piece (5, 6) of another player if a double is thrown;
- a player may obtain an additional turn, or place an extra playing piece, or convert a single into a double if a specific question is answered correctly.

With this last additional rule, the game may be further used as a teaching game. The questions may be selected to test the understanding of a subject or advance a student's knowledge of a field, as is desired. The questions may be stored on cards, for use in a game using a physical board (2, 22), or be incorporated in the program for the electronically controlled game. This option may be added to any of the preferred embodiments (with minor variations), if so desired, without departing from the scope of the invention.

Figure 5:
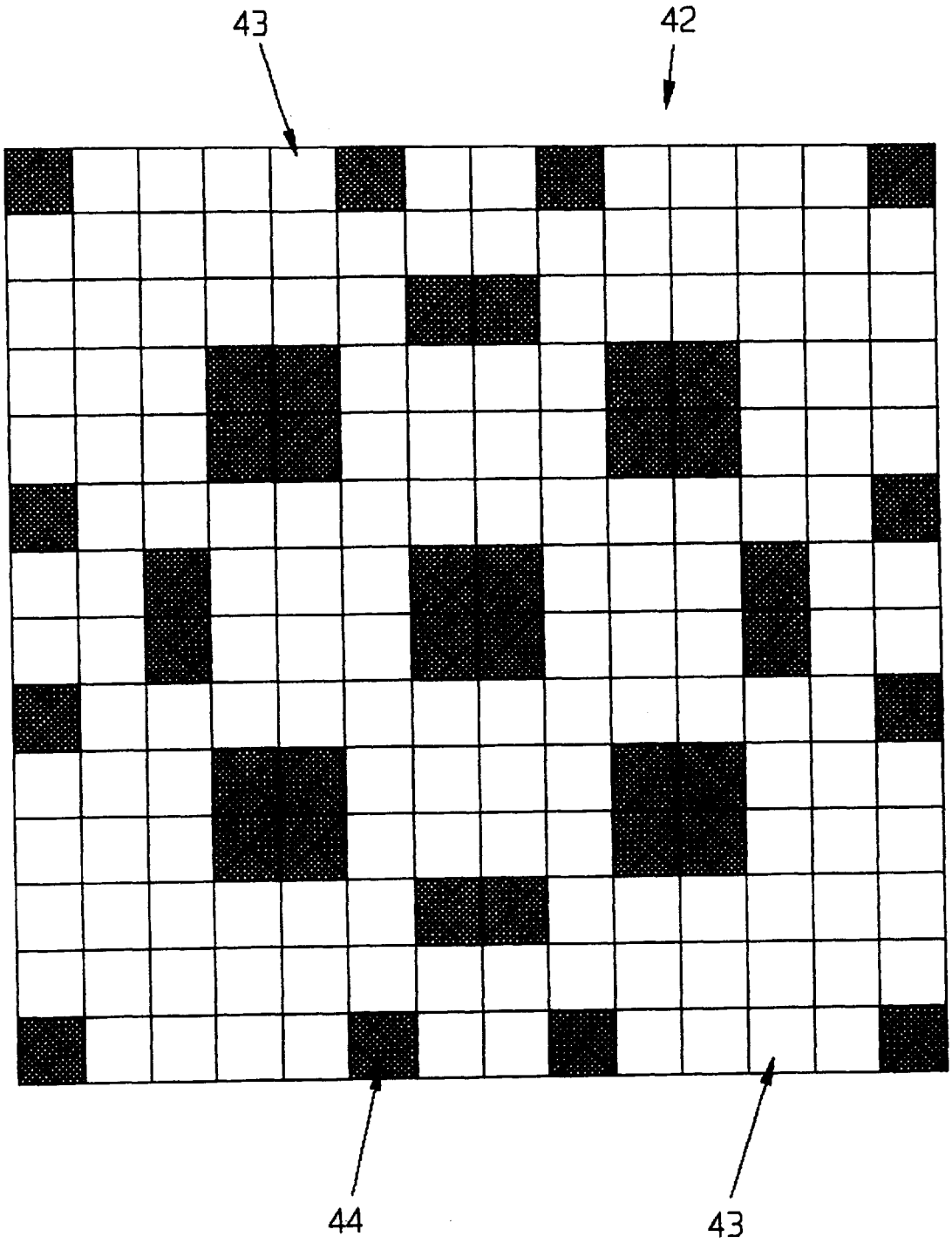
FIG. 5 is a plan view of a third preferred embodiment of the playing surface of the present invention.

A third preferred embodiment of the present invention uses a board 42 (FIG. 5) without any numbers within the squares 3. Each player is allocated playing pieces (5, 6) with a set of three blockers 7.

Each player can place three pieces (5 or 6) on the board 42 at each turn. An example of the winning line is as shown in FIG. 3 (for the first and second preferred embodiments). However, the placement of the pieces (5, 6) is now determined by the player alone, without the use of dice or other random number generators as there are no corresponding icons on the board 42. Otherwise the rules of the game are as described for the first preferred embodiment of the invention.

A fourth preferred embodiment of the invention could use any preferred embodiment of the board (2, 22 or 42). The difference in this embodiment is that each player is given a limited, pre-determined number of playing pieces (5 or 6) and blockers 7. For example each player may receive ten or fifteen playing pieces (5 or 6) and three blockers 7. Once these pieces are used in accordance with the rules, that player is unable to play any more pieces. The winner in such an embodiment of the game is the player who forms a winning line; or who is closest to forming a winning line, or there is no winner and the game is drawn.

In a fifth preferred embodiment of the present invention, the variations of the rules described above in the fourth embodiment could also be used with the first and second embodiments, that is: with a random number generator (or one or more dice) and set of icons (3) on the playing surface (2, 22). Alternatively, and if so desired, the rules of the game may be adapted so that each player pre-selects the icons (3) which they may play before the game begins and at each turn determines and plays a selection of the icons (3) in order to obtain a winning line for the game.

It will be appreciated that the game, in any embodiment, may be played electronically as described above, with the players being remote from each other. For example, the game may be played across the internet or any other network of electronic machinery with the appropriate equipment at the site of each player.

It will also be appreciated that with appropriate programming in the third embodiment, and appropriate modification or addition to the rules for the first two embodiments, that the game may be played by one player only, playing "against the computer" or with pre-set rules determining the play by one or more imaginary players.

We claim:

1. A method of playing a board game comprising the steps of:

providing a plurality of sets of playing pieces, one set for use by one player, the sets being visually distinctive one from any other set, each one set including a plurality of identical playing pieces;

providing a playing surface which contains a plurality of defined spaces arrayed in two dimensions within a framework, each space containing thereon an identifying icon, wherein each icon is selected from a group of icons of finite number and wherein each icon appears on the playing surface a plurality of times;

providing one or more random icon generators, each of which includes at least one occurrence of each icon on the playing surface;

ascertaining the number of players, determining the player to play first and determining the conditions for forming a winning line of playing pieces on the playing surface that is the condition for winning the game regardless of any numerical values used to identify the spaces on the playing surface;

allocating each player a set of playing pieces and determining the number of random icon generators to be used by each player in a turn;

each player in turn, generating a series of random icons on the random icon generator, and selecting and placing the playing pieces of the allocated set of playing pieces on the playing surface on icons corresponding to the icons generated for that turn, said number of playing pieces being determined by the icons showing on that turn on the random icon generator; and continuing the steps of generating a random icon and selecting and placing playing pieces until one player forms the pre-determined winning line of playing pieces required to win the game.

2. A method of playing a board game as claimed in claim 1, wherein the winning line is achieved by the first player to fulfill one of the conditions selected from the following:

forming a continuous line of playing pieces from one side of the playing surface to the opposite side;

forming a continuous line of playing pieces from one side of the playing surface to the opposite side by defining links between adjacent pieces at 90° or 180°;

forming a continuous line of playing pieces from a first corner of the playing surface to a second corner;

forming a continuous line of playing pieces which passes through one or more predetermined squares; and forming a line of playing pieces in a pre-determined and geometric pattern on the playing surface.

3. A method of playing a board game as claimed in claim 1, wherein the random icon generators are dice and two or more die are used.

4. A method of playing a board game as claimed in claim 1, wherein the icons are a set of representations which is selected from the group consisting of: numbers, letters, colors, sets of graphic representations, symbols, or a combination of any of these.

5. A method of playing a board game as claimed in claim 1, wherein the playing surface is a board with a framework that is a geometric shape and each icon appears on the surface of the board the same number of times as any other icon.

6. A method of playing a board game as claimed in claim 1, wherein the playing surface includes special spaces which can be used by one player or more than one player when a special combination of random numbers is generated at the same time.

7. A method of playing a board game as claimed in claim 1, wherein the method is embodied in a computer program, a playing surface is displayed on one or more visual display units, and the placement of playing pieces is conducted by keyboard strokes or other computer control device.

8. A method of playing a board game for one or more players, comprising the steps of:

providing a set of playing pieces for a player, each set being visually distinctive from any other set, each set including a plurality of pieces;

providing a playing surface which contains a plurality of defined spaces arrayed in two dimensions within a framework;

ascertaining the number of players, a player to play first and pre-determining the conditions for forming a winning line formed of the playing pieces on the playing surface that is the condition to win the game regardless of any numerical value used in identifying the spaces on the playing surface;

allocating each player a set of playing pieces and determining the number of pieces to be played at each turn;

each player placing one or more of the allocated set of playing pieces on the playing surface in accordance with a determination of the best space out of a number of possible spaces to place a playing piece in order to win the game; and the players continuing turn by turn until one player has placed his playing pieces in the form of the pre-determined winning line for that game.

9. A method of playing a board game for one or more players as claimed in claim 8, wherein a winning combination is achieved by the first player to fulfill the conditions selected from the following:

forming a continuous line of playing pieces from one side of the playing surface to the opposite side;

forming a continuous line of playing pieces from one side of the playing surface to the opposite side by defining links between adjacent pieces at 90° or 180°;

forming a continuous line of playing pieces from a first corner of the playing surface to a second corner;

forming a continuous line of playing pieces which passes through one or more predetermined squares; and forming a line of playing pieces in a pre-determined and geometric pattern on the playing surface.

10. A method of playing a board game for one or more players as claimed in claim 8, wherein icons are used to identify the spaces and are a set of representations which is selected from the group consisting of: numbers, letters, colors, sets of graphic representations, symbols, or a combination of any of these.

11. A method of playing a board game for one or more players as claimed in claim 8, wherein the playing surface is a board with a framework that is a geometric shape and each icon appears on the surface of the board the same number of times as any other icon.

12. A method of playing a board game for one or more players as claimed in claim 8, wherein each set of playing pieces includes a plurality of sub-sets of identical playing pieces, each sub-set having one or more rules about when a playing piece from that sub-set may be played.

13. A method of playing a board game for one or more players as claimed in claim 8, wherein the method is embodied in a computer program, the sets of playing pieces, playing surface and random icon generator being electronically generated, and a playing surface being displayed on one or more visual display units, and the placement of playing pieces being conducted by keyboard strokes or other computer control device.

14. A method of playing a board game for one or more players, comprising the steps of:

providing a set of playing pieces for a player, each set including a plurality of sub-sets of playing pieces, each sub-set being playable in accordance with a pre-determined condition, each set being visually distinctive from any other set, and each sub-set including a limited, pre-determined number of identical pieces;

providing a playing surface which contains a plurality of defined spaces arrayed in two dimensions within a framework;

ascertaining the number of players, a player to play first, and a pre-determined condition for forming a winning line of playing pieces on the playing surface that is a condition for winning the game regardless of any numerical value used to identify the spaces;

allocating each player a set of playing pieces, and determining the number or combination of pieces which can be played at each turn;

allowing each player to place one or more of the allocated set of playing pieces on the playing surface in accordance with a determination of the best space our of a number of possible spaces to win a game and in accordance with the determination of the number of pieces or combination of pieces which may be played at any one turn; and the players continuing until one player has achieved a line of pieces that forms the pre-determined winning line for that game, or all players cannot play any further.

15. A method of playing a board game for one or more players as claimed in claim 14, wherein a winning combination is achieved by the first player to fulfill the conditions selected from the following:

a continuous line of playing pieces from one side of the playing surface to the opposite side;

a continuous line of playing pieces from one side of the playing surface to the opposite side, in which line are links between adjacent pieces at 90° or 180°;

forming a continuous line of playing pieces from one corner of the playing surface to a second corner;

forming a continuous line of playing pieces which passes through one or more predetermined squares; and a line of playing pieces which is formed in a pre-determined and geometric pattern on the playing surface.

16. A method of playing a board game for one or more players as claimed in claim 14, wherein icons are used to identify the spaces and are a set of representations which is selected from the group consisting of: numbers, letters, colors, sets of graphic representations, symbols, or a combination of any of these.

17. A method of playing a board game for one or more players as claimed in claim 14, wherein the method is embodied in a computer program, a playing surface is displayed on one or more visual display units, and the placement of playing pieces is conducted by keyboard strokes or other computer control device.

* * * * *